US005184276A

United States Patent [19]

Simon

[11] Patent Number: 5,184,276

[45] Date of Patent: Feb. 2, 1993

[54] ELECTROSTATIC PAINT SPRAY GUN

[75] Inventor: Georg Simon, Altstatten, Switzerland

[73] Assignee: Wagner International AG, Switzerland

[21] Appl. No.: 711,170

[22] Filed: Jun. 5, 1991

[30] Foreign Application Priority Data

Jun. 26, 1990 [DE] Fed. Rep. of Germany ..... 4020289

[51] Int. Cl.[5] ..... B05B 5/025

[52] U.S. Cl. ..... 361/228; 361/235; 239/690

[58] Field of Search ..... 361/225, 226, 227, 228, 361/230, 235; 363/59, 60, 61; 307/109, 110; 239/690

[56] References Cited

U.S. PATENT DOCUMENTS

| | | | |
|---|---|---|---|
| 3,599,038 | 8/1971 | Skidmore | 361/228 |
| 3,608,823 | 9/1971 | Buschor | 239/690 |
| 3,731,145 | 5/1973 | Senay | 361/228 |
| 3,938,739 | 2/1976 | Bertilsson | 239/705 |
| 4,033,506 | 7/1977 | Braun | 361/228 |
| 4,196,465 | 4/1980 | Buschor | 361/228 |
| 4,287,552 | 9/1981 | Wagner et al. | 361/228 |
| 4,290,091 | 9/1981 | Malcolm | 361/228 |
| 4,323,947 | 4/1982 | Huber | 361/228 |
| 4,377,838 | 3/1983 | Levey et al. | 361/228 |
| 4,441,656 | 4/1984 | Huber | 239/708 |
| 4,529,131 | 7/1985 | Rutz | 239/690 |
| 4,572,437 | 2/1986 | Huber et al. | 239/703 |
| 4,651,932 | 3/1987 | Huber et al. | 239/707 |
| 4,750,676 | 6/1988 | Huber et al. | 239/705 |
| 4,752,034 | 6/1988 | Kuhn et al. | 239/690 |
| 4,775,105 | 10/1988 | Reese | 239/704 |
| 5,067,434 | 11/1991 | Thür et al. | 361/228 |

FOREIGN PATENT DOCUMENTS

| | | |
|---|---|---|
| 3126936 | 8/1981 | Fed. Rep. of Germany . |
| 2522991 | 9/1983 | France . |

*Primary Examiner*—Jeffrey A. Gaffin

[57] ABSTRACT

In an electrostatic paint spray gun having a built-in high-voltage cascade that is cast into an insulator member together with a transformer, a carrier tube is provided that is composed of a tube section and of an annular flange, whereby the electrical component parts of the high-voltage cascade are arranged and fixed at the outside jacket of the tube section and the output resistors are arranged and fixed at the annular flange. The inside bore of the tube carrier can serve as a receptacle for the high-voltage stranded electrode conductor.

11 Claims, 3 Drawing Sheets

ELECTROSTATIC PAINT SPRAY GUN

BACKGROUND OF THE INVENTION

The invention is directed to an electrostatic paint spray gun having a built-in high-voltage generator which is composed of a transformer and of a high voltage cascade following thereupon and extending into the gun barrel, whereby the low voltage input of the cascade is connected to the transformer output, its high voltage output is connected to the high voltage electrode of the gun with a stranded lead via output resistors, and whereby transformer and cascade are cast into an insulating member.

German Patent No. 31 26 936 A1 discloses such a spray gun. In these known paint spray guns, the high-voltage cascade is given its stability only on the basis of the hardened casting compound. This, however, produces the risk that component parts, i.e. capacitors and diodes, of the cascade will shift or twist relative to one another before or during the casting or during the time span between casting and hardening of the casting compound, this potentially leading to over-stressing of the solder joints of the cascade and to insulation problems.

SUMMARY OF THE INVENTION

It is therefore an object of the present invention to ensure that an exact positioning of the component parts of the cascade as well as the resistors and connecting lines connected thereto is guaranteed in the casting. This object is achieved by arranging the high voltage cascade on a carrier tube that comprises an annular flange with bores for the positioning of the output resistors.

In accord with the invention, thus, the capacitors, the diodes and the resistors of the high-voltage side are arranged on the carrier tube having the end flange, this guaranteeing both a rigid positioning of these component parts relative to one another as well as of the entire cascade vis-a-vis the transformer both before and during the casting, this reducing manufacturing rejects and enhancing the insulating reliability and useful life of the cascade.

When the high-voltage output of the cascade faces toward the transformer, the interior of the carrier tube, in an embodiment of the invention, serves the purpose of guiding the stranded electrode lead and the purpose of connecting that lead to the high-voltage output of the cascade.

BRIEF DESCRIPTION OF THE DRAWINGS

The invention shall be set forth in greater detail below with reference to the drawings. Shown are.

As mentioned, the invention is particularly suited for employment in a transformer-cascade arrangement as disclosed in pending application Ser. No. 541,514, incorporated herein by reference. In order to facilitate an understanding of the invention, this arrangement shall first be set forth below with reference to FIG. 1.

Figure 1:
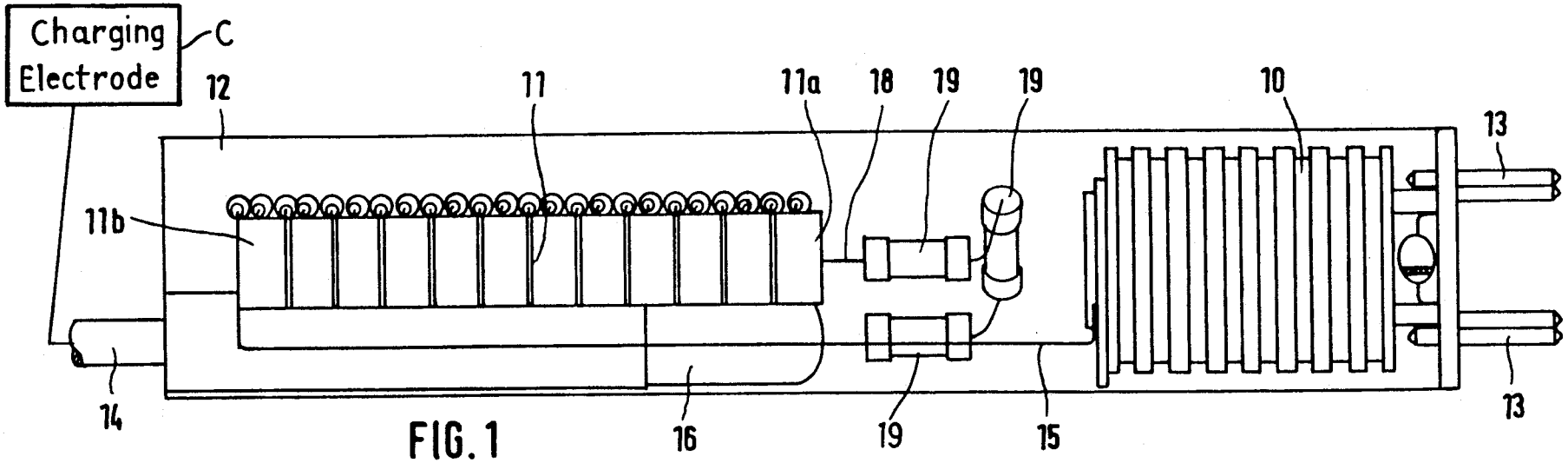
FIG. 1 is a longitudinal section through the insulator member containing the transformer and high-voltage cascade.
Figure 1A:
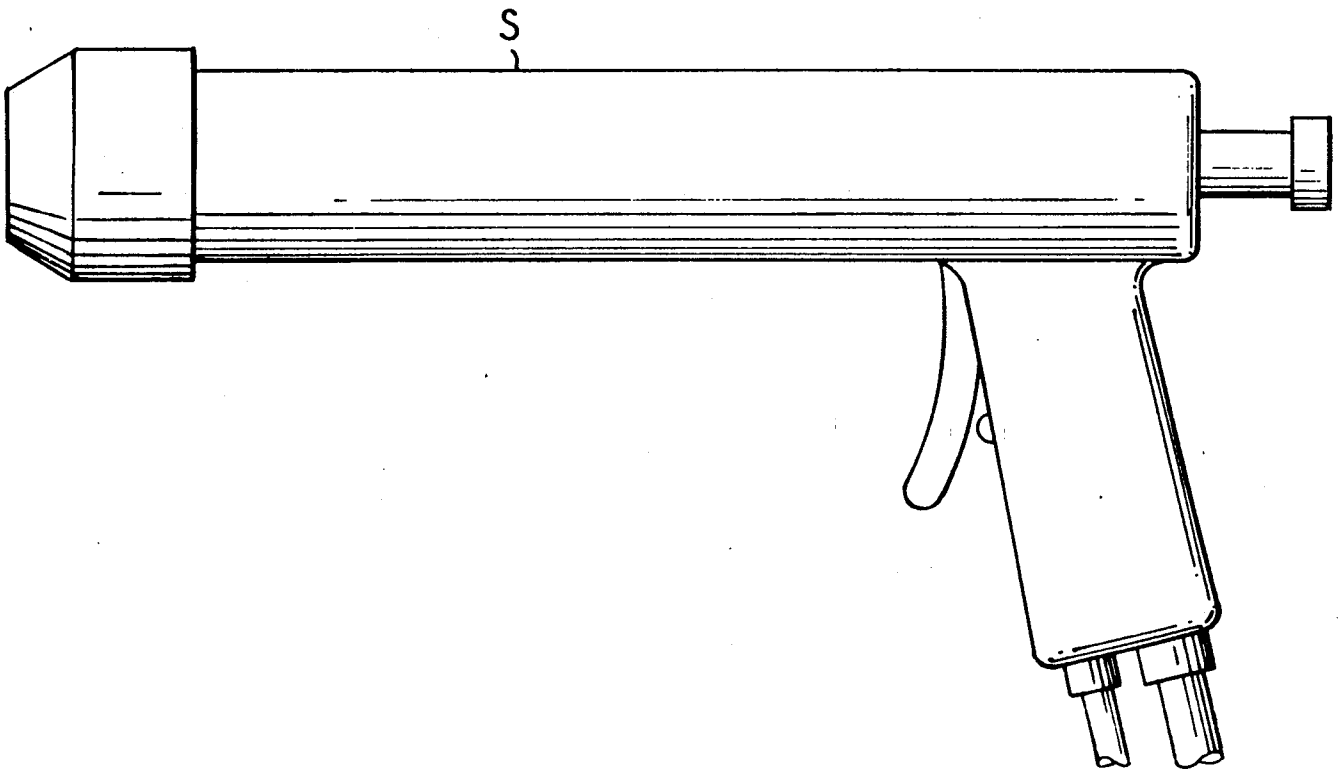

In FIG. 1, 10 references a transformer and 11 references a high-voltage cascade, whereby these two component parts are arranged coaxially in succession and are cast into a common insulator member 12 having a cylindrical shape. This insulator member 12 is introduced in a known way into the barrel of the electrostatic paint spray gun S, as shown in FIG. 1*a*. Two terminal pins 13 for connection of the low-voltage side (primary coil) of the transformer 10 to a main line project from the rear end face of the insulator member 12. A clad, stranded lead 14 that supplies the high-voltage delivered from the high-voltage output of the cascade 11 to the charging electrode C of the paint spray gun projects from the front face of the insulator member. What is then critical is that, contrary to the standard arrangement, the high-voltage output 11*a* of the high-voltage cascade 11 faces toward the transformer 10 and the low-voltage input 11*b* faces away from the transformer 10. The output line 15 of the transformer 10 therefore leads to the cascade 11 there along and parallel to the axis thereof and discharges into the low-voltage input 11*b* of the cascade 11 facing away from the transformer 10. The line 15 is thereby a non-clad wire. A small tube 16 that is likewise composed of insulator material is cast into the insulator member 12, this small tube 16 being fashioned as a plug receptacle at its end facing toward the transformer 10. A line wire 18 departing the high-voltage end 11*a* of the cascade 11 leads via known output resistors 19 to the plug receptacle of the small tube and is conductively connected thereto, for instance by soldering. The other end of the small tube 16 discharges at the front end face of the insulator member 12 and the stranded electrode lead 14 is introduced into the small tube proceeding from this open end, whereby the front end of the stranded conductor is stripped and introduced into the plug receptacle under pressure. For further improving the insulation, an insulating fluid can be filled air-free into the small tube 16 and a liquid-tight and air-tight closure can be subsequently achieved with an O-ring.

Figure 2:
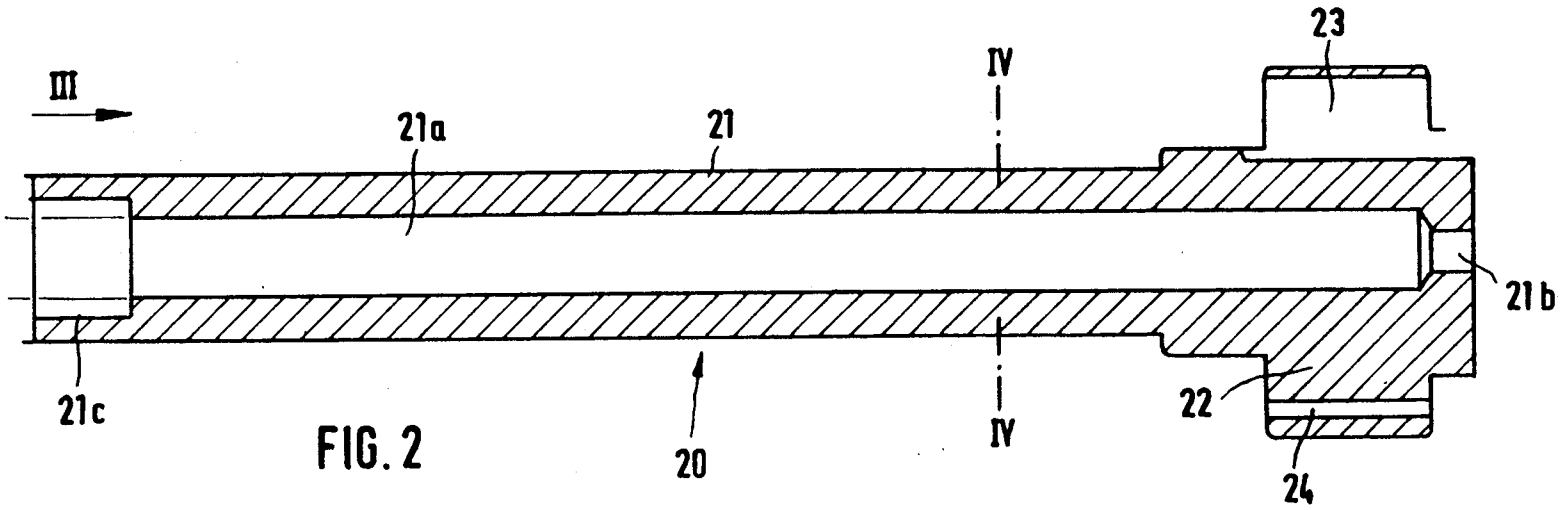
FIG. 2 is a longitudinal section through a cascade carrier tube of the present invention, this being employable in an arrangement of FIG. 1.
Figure 3:
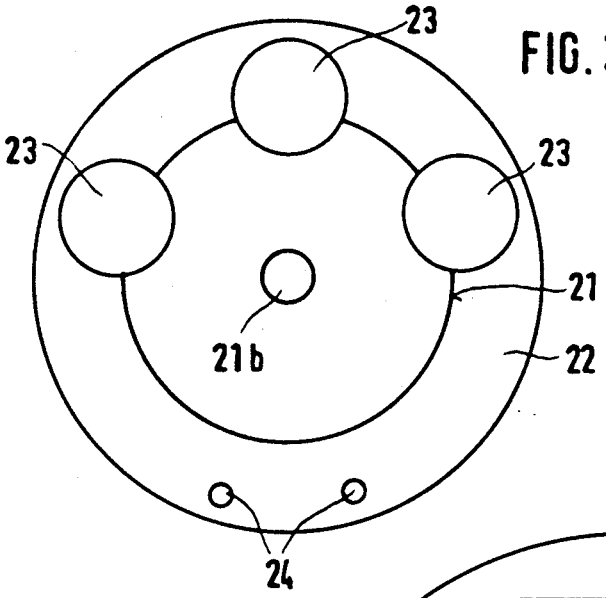
FIG. 3 is a plan view onto the carrier tube of FIG. 2, namely in the direction of the arrow referenced III in FIG. 2.

For stabilizing the high-voltage cascade referenced 11 in FIG. 1, a carrier tube 20 is then provided in conformity with the present invention, this being shown in a longitudinal section in FIG. 2. The carrier tube is composed of a tube section 21 and of an annular flange 22 of one piece therewith that is situated in an end region of the tube section 21. As may be seen from FIG. 3, the annular flange 22 comprises three bores 23 having a comparatively large diameter and comprises two bores 24 having a comparatively small diameter. The inside bore 21*a* of the tube section 21 has a tapered region 21*b* at its end at the side of the flange (at the right in FIG. 2) and has a conically expanding region 21*c* at its opposite end (at the left in FIG. 2).

Figure 4:
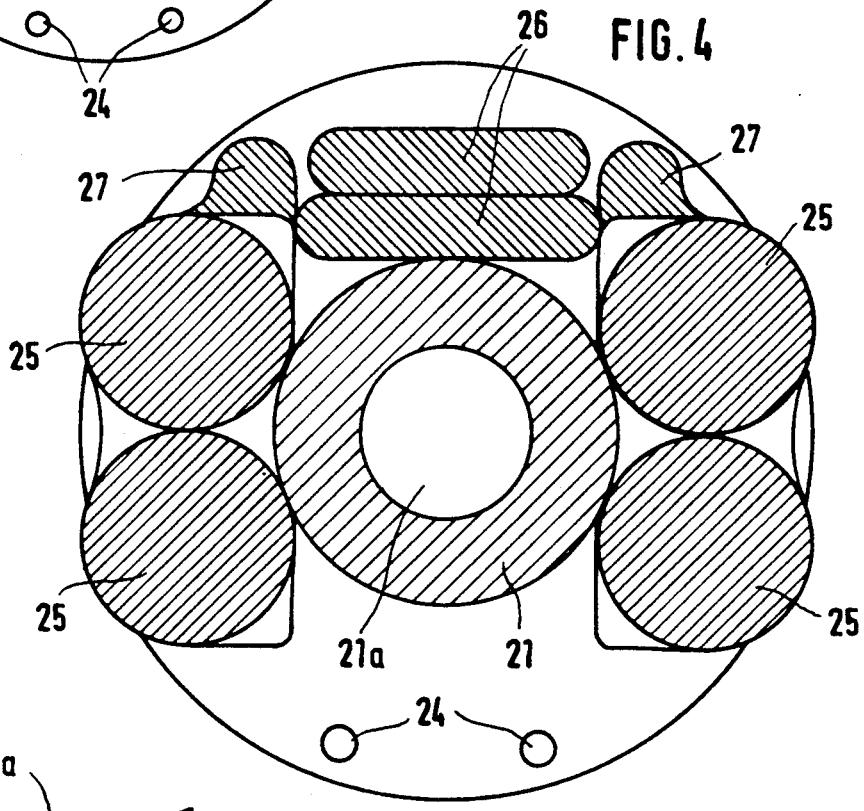
FIG. 4 a section along the line IV—IV of FIG. 2, namely with capacitors and diodes put in place on the carrier tube.

The component parts of the high-voltage cascade (cascade 11 of FIG. 1) are arranged on the carrier tube 20, as shown in FIG. 4. Two packets of capacitors 25 are thereby arranged at the tube section 21*a* at the right and at the left. Diodes 26 are arranged at the top at the tube section 21*a*, whereby the capacitor packets are connected crossed to one another in a known way by the diodes. Solder points 27 are also shown.

The electrical connection of the high-voltage cascade ensues in the following way, whereby FIG. 1 is again referenced. The output line 15 of the transformer 10 composed of two bare wires is threaded through the bores 24 of the flange 22 and is conducted up to the left-hand end of the tube section 21 below and parallel to the tube section 21, being connected to the low-voltage input 11*b* of the cascade 11 at this left-hand end of the tube section 21. For the connection at the high-voltage side, the small tube 16 is first introduced into the inside bore 21*a* of the carrier tube 20 proceeding from the left, whereupon a clamp sleeve (not shown) is pressed into the conical region 21*c* of the tube section 21, so that the small tube 16 is locked in the inside bore 21*a*. The line wire 18 departing the high-voltage end 11*a* of the cascade 11 is now passed through the region 21*b* and introduced into the plug receptacle of the small tube 16 and is conductively connected thereto. The three output resistors 19 of the output line 18 are thereby plugged into the three bores 23 of the flange 22 and are thus reliably positioned. The casting can now ensue so that the insulating member 12 arises. The stranded electrode lead 14 is then pushed into the small tube through the clamp sleeve discharging at the front end face of the insulator member 12 and the stripped leading end of the stranded conductor is pushed under pressure into the plug receptacle situated at the other end of the small tube. Finally, insulating oil is also filled into the small tube and the open mouth of the annular gap is sealed with an O-ring.

Figure 5:
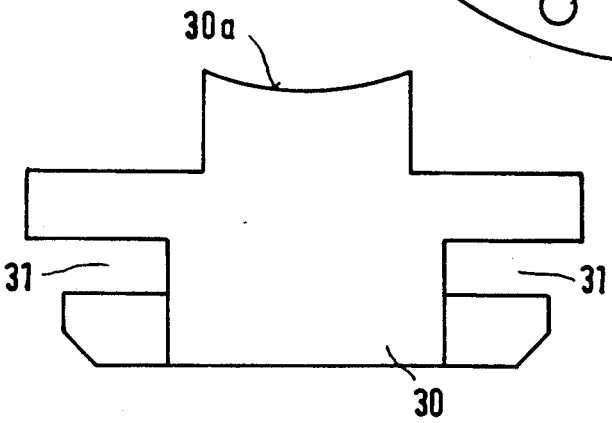
FIG. 5 a cross section through a stranded conductor guide that can be attached to the carrier tube of FIG. 2.

In a development of the invention, a cable guide as shown in cross section in FIG. 5 can be attached to the underside of the tube section 21 that is not occupied by electrical component parts. This cable guide 30 extends essentially from the left-hand end (FIG. 2) of the tube section 21 up to the flange 22 and its upper side 30*a* is curved in accord with the outside jacket of the tube section 21. The cable guide 30 comprises two longitudinal slots 31 that serve the purpose of accepting the low-voltgae wires 15. The wires 15 that have been threaded through the flange bores 24 here, thus, do not proceed freely under the tube section 21 up to the low-voltage input 11*b* of the cascade 11 but are guided in the slots 31. Over and above this, the cable guide 31 guarantees an attitudinally exact positioning of the cascade 11 and protects this against twisting. As shown, the cable guide 30 can be an independent component part that is secured to the tube section 21; however, it is also possible to apply the cable guide 30 to the tube section 21 so that it represents an integral component part of the carrier tube 20.

The carrier tube 20, the small tube 16 and the cable guide 30 are expediently manufactured of a material that enters into an intimate bond with the casting compound of the insulating member 12, so that no gap between these component parts and the casting compound derives after the casting.

The invention is not limited to the exemplary embodiment that has been shown. Thus. for example, it is possible to apply not only the cable guide 30 to the carrier tube 21 but the small tube 16 can also be an integral component part of the tube section 21; expressed in other words, the inside jacket of the tube section 21 can be fashioned such that a separate small tube 16 is superfluous. Finally, the carrier tube of the invention can be employed not only when, as in the described arrangement, the output of the cascade at the high-voltage side is adjacent to the transformer but the employment thereof is always expedient when an exact and stable positioning of the high-voltage cascade and the component parts thereof relative to one another is to be achieved.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An electrostatic paint spray gun having a built-in high-voltage generator comprising a transformer and a high-voltage cascade following thereupon and extending in a barrel of said gun, whereby a low-voltage input of said cascade is connected to an output of said transformer, a high-voltage output of said cascade is connected to a high-voltage electrode of said gun with a stranded lead via output resistors, and said transformer and cascade are cast into an insulating member, said high-voltage cascade being arranged on a carrier tube having an annular flange with bores for the positioning of said output resistors.

2. An electrostatic paint spray gun according to claim 1 wherein the high-voltage output of the high-voltage cascade faces toward the transformer, and the stranded electrode lead is conducted through an inside bore of the carrier tube and is connected to the high-voltage output of the high-voltage cascade inside said inside bore.

3. An electrostatic paint spray gun according to claim 2, further comprising a small tube of insulator material having an end adjacent to the high-voltage output of the cascade fashioned as a plug receptacle and conductively connected thereto and having an other end which discharges toward an outside of said insulating member, whereby the stranded electrode lead is introduced into the small tube of insulator material and has a stripped end plugged into the plug receptacle, the inside bore of the carrier tube being fashioned a receptacle for said small tube of insulating material.

4. An electrostatic paint spray gun according to claim 2, wherein guide bores for stranded low-voltage conductors are provided in the annular flange of the carrier tube.

5. An electrostatic paint spray gun according to claim 2, wherein a cable guide is attached to the carrier tube.

6. An electrostatic paint spray gun comprising a barrel and a built-in high-voltage generator comprising a transformer and a high-voltage cascade extending into said barrel, a low-voltage input of said cascade being connected to an output of said transformer, a high-voltage output of said cascade being connected to a high-voltage electrode of said gun via output resistors, and said transformer and cascade being cast into an insulating member, said high-voltage cascade being arranged on a carrier tube having recesses for receiving said output resistors.

7. An electrostatic paint spray gun according to claim 6, wherein said high-voltage output of said high-voltage cascade faces toward said transformer, and a stranded lead is connected from said resistors to said high-voltage electrode, said lead being conducted through an inside bore of said carrier tube.

8. An electrostatic paint spray gun according to claim 7, further comprising a small tube of insulator material having an end adjacent to said high-voltage output of said cascade fashioned as a plug receptacle and conductively connected thereto and having an other end which discharges toward an outside of said insulating member, whereby said stranded lead is introduced into said small tube of insulator material and has a stripped end plugged into said plug receptacle, an inside bore of said carrier tube being fashioned as a receptacle for said small tube of insulating material.

9. An electrostatic paint spray gun according to claim 7, wherein said carrier tube has an annular flange and said recesses are positioned in said flange.

10. An electrostatic paint spray gun according to claim 7, wherein said annular flange includes guide bores for receiving low-voltage conductors extending between said transformer and said low voltage input of said cascade.

11. An electrostatic paint spray gun according to claim 7, wherein a cable guide is attached to said carrier tube for receiving leads connected to said cascade.

* * * * *